US006961717B1

(12) United States Patent
Pierce

(10) Patent No.: US 6,961,717 B1
(45) Date of Patent: Nov. 1, 2005

(54) METHOD FOR POSITIONING AN INDICIUM FOR PRINTING ON A SUBSTRATE AND A SYSTEM FOR CARRYING OUT SUCH METHOD AND MAILPIECE PRODUCED BY SUCH METHOD

(75) Inventor: Jeffrey D. Pierce, Newtown, CT (US)

(73) Assignee: Pitney Bowes Inc., Stamford, CT (US)

( * ) Notice: Subject to any disclaimer, the term of this patent is extended or adjusted under 35 U.S.C. 154(b) by 922 days.

(21) Appl. No.: 09/618,591

(22) Filed: Jul. 17, 2000

(51) Int. Cl.[7] ..... G07B 17/00
(52) U.S. Cl. ..... 705/408; 283/71
(58) Field of Search ..... 283/71; 705/401, 705/408

(56) References Cited

U.S. PATENT DOCUMENTS 4,843,572 A * 6/1989 Linkowski et al. ..... 358/1.1
4,868,757 A * 9/1989 Gil ..... 705/406
5,707,158 A 1/1998 Hansel et al.
5,729,461 A 3/1998 D'Andrea, et al.
6,408,286 B1 * 6/2002 Heiden ..... 705/408
6,461,063 B1 * 10/2002 Miller et al. ..... 400/76

FOREIGN PATENT DOCUMENTS

WO WO 97/14117 A2 * 4/1997

OTHER PUBLICATIONS

Terrell: "Licking stamps: a PC and a printer will end trips to the postoffice."; U.S. News & World Report, Sep. 29, 1998, vo 125, No. 12, pp. 67.*

* cited by examiner

*Primary Examiner*—Edward R. Cosimano
(74) *Attorney, Agent, or Firm*—Charles R. Malandra, Jr.; Angelo N. Chaclas

(57) ABSTRACT

A method for positioning an indicium for printing on substrate. The indicium can be an IBIP type indicium and the substrate can be the surface of an envelope. The substrate has printable and complementary unprintable areas and a reserved clear area where printing is possible but unacceptable. The unprintable area is determined as function of printer characteristics and substrate dimensions. If the indicium overlaps the reserved clear area the indicium is modified by shifting portions of the indicium with respect to each other so that none overlaps the reserved clear area.

12 Claims, 4 Drawing Sheets

METHOD FOR POSITIONING AN INDICIUM FOR PRINTING ON A SUBSTRATE AND A SYSTEM FOR CARRYING OUT SUCH METHOD AND MAILPIECE PRODUCED BY SUCH METHOD

BACKGROUND OF THE INVENTION

The subject invention relates to printing indicia, such as indicia which evidence payment of postage for a mailpiece, on a substrate, such as a mailpiece envelope. More particularly it relates to positioning of such indicia for printing where the printable and unprintable areas of the substrate vary and the substrate includes reserved clear areas, i.e. areas where printing may be possible but is excluded by the application software, in compliance with postal service regulations or other reasons.

Recently a new way of franking mailpieces to evidence payment has been developed and introduced by the assignee of the subject invention in accordance with the Information Based Indicia Program (IBIP) of the U.S. Postal Service. Unlike previous forms of proof of payment such as stamps and postage meter indicia, IBIP indicia do not rely on details of the printing process to provide security but instead incorporate encrypted information unique to each indicium which cannot be produced without knowledge of secret cryptographic keys. IBIP indicia have many advantages. For example, the information incorporated into the indicia not only provides security against counterfeit indicia, but allows the Postal Service to more closely track its operations and the needs of its customers. A particular advantage of IBIP and similar indicia is that, because they do not rely upon particular details of the printing process for security, mailers can print indicia themselves with a conventional digital printer. The Assignee of the subject invention has recently introduced a service under the trade name CLICKSTAMP® ONLINE which enables mailers to print IBIP type indicia using their own digital printers.

The advantages of such a service are apparent since mailers can now generate postal indicia with their own general purpose data processing systems and digital printers. A corresponding problem however, is that, with the wide variety of systems and printers in use, printing various sizes of mailpieces, it becomes difficult to assure that the indicium will be printed in accordance with the Postal Service regulations since different combinations of systems and mailpiece size can have different printable and unprintable areas. This problem is further complicated by the greater size of IBIP type indicia and by the Postal Service requirement for a reserved clear area for provision of a "FIM mark". (FIM marks are marks printed on a mailpiece which are used by Postal Service automatic mail handling equipment to identify the printed surface of a mailpiece and its orientation. By Postal Service regulation FIM marks are positioned along the upper edge of the mailpiece a specified distance from the right edge.)

Thus it is an object of the subject invention to provide a method for producing a mailpiece having a properly positioned IBIP type indicium even though the indicium can be printed by different systems on varying sizes of mailpieces.

BRIEF SUMMARY OF THE INVENTION

The above object is achieved and the disadvantages of the prior art are overcome in accordance with the subject invention by a method for printing an indicium on a substrate which can be part of a mailpiece and a system for carrying that method. The system includes a digital printer controlled by a data processing system to print an indicium on a surface of a substrate, the surface comprising a fixed reserved clear area, a variable unprintable area and a printable area. The system is programmed for: a) determining a digital representation of the indicium, the representation including a plurality of portions; b) determining the variable unprintable area as a function of the dimensions of the substrate and characteristics of the printer; c) determining a position for the indicium to be printed in the printable area; d) determining if printing the indicium in the position will cause one or more of the portions to overlap the fixed reserved clear area, and if not, downloading the representation to the printer for printing in the first position; and if so e) modifying the representation to shift portions in a predetermined manner in relation to each other so that none of the portions overlaps the fixed reserved clear area, and downloading the modified representation to the printer for printing in the position. Thus the indicium can be printed by different types of printers on substrates having different dimensions without overlap of fixed reserved clear areas despite variation in unprintable areas.

In accordance with one aspect of the subject invention the indicium is a postal indicium evidencing payment of postage and the substrate comprises a mailpiece.

In accordance with another aspect of the subject invention the indicium comprises encrypted data which cannot be generated without knowledge of a secret encryption key to provide security against unauthorized generation of indicia.

In accordance with another aspect of the subject invention the portions comprise a first portion and a second portion.

In accordance with still another aspect of the subject invention the first portion is normally positioned to the right of the reserved clear area and the second portion is normally positioned below the reserved clear area, and if the first portion overlaps the reserved clear area, the indicium is modified by shifting the first portion to the left of the reserved clear area.

In accordance with still yet another aspect of the subject invention the first portion is normally positioned to the right of the reserved clear area and the second portion is normally positioned below the reserved clear area and the first portion, and if the first portion overlaps the reserved clear area, the indicium is modified by shifting the second portion to the left and shifting the first portion below the reserved clear area into an area vacated by the second portion.

Other objects and advantages of the subject invention will be apparent to those skilled in the art from consideration of the detailed description set forth below and the attached drawings.

DETAILED DESCRIPTION OF PREFERRED EMBODIMENTS OF THE INVENTION

Figure 1:
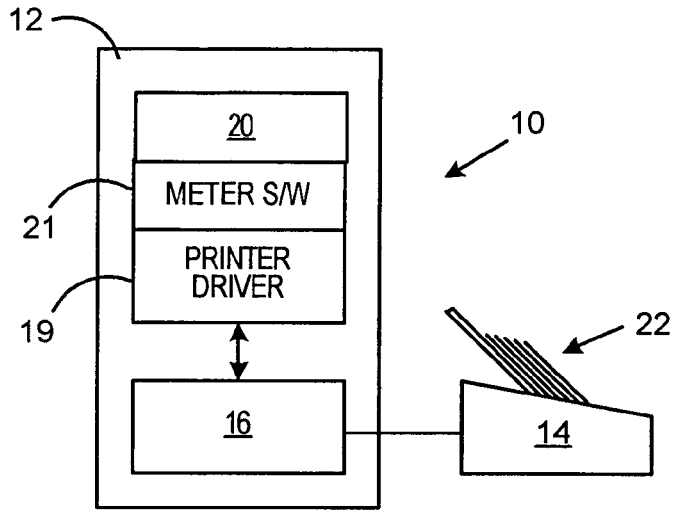
FIG. 1 shows a schematic block diagram of a system for printing IBIP type envelopes.

FIG. 1 shows system 10 for printing IBIP type indicia. System 10 includes a data processing system 12 and conventional digital printer 14 which can be a laser printer or ink jet printer or other similar printer. Data processing system 12 includes a processor 16 and memory 20 for storing data and control programs for generating indicia and controlling printer 14 to print indicia on envelopes 22. Memory 20 stores conventional printer driver 19 for controlling printer 14. As is well known, by proper selection of driver 19 any of a variety of different printers can be used as printer 14 without the need to change the application software.

Memory 20 also stores meter software 21 which controls data processing system 12 to carry out meter functions such as requesting encrypted data needed to generate an IBIP type indicium from a service provider and formatting of such an indicium. Such software is known and need not be discussed further here for an understanding of the subject invention except to note that software 21 is modified in accordance with the subject invention to adjust the design and location of the indicium to avoid reserved clear areas, as will described further below.

Figure 2:
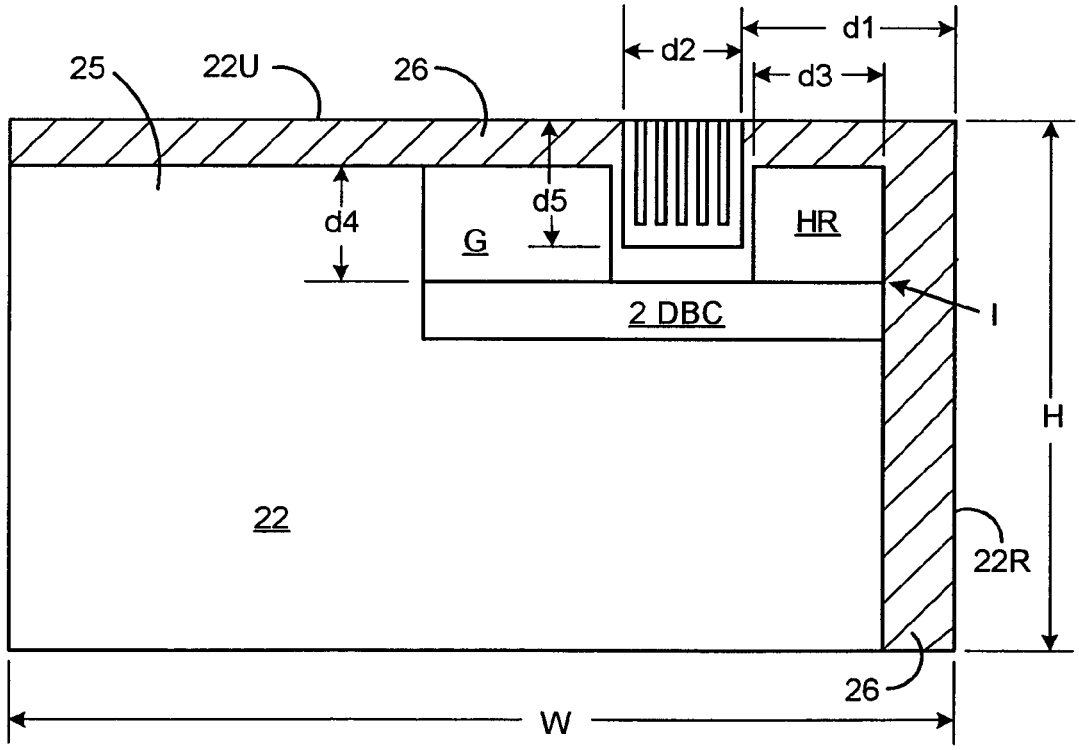
FIG. 2 ( PRIOR ART )
FIG. 2 shows a schematic representation of a mailpiece having an IBIP type indicium printed in a conventional manner.

FIG. 2 shows mailpiece 22, also referred to herein as envelope 22, which is printed with indicium I in a conventional manner. Envelope 22 functions as a substrate for printing indicium I, which consists of three portions: human readable portion HR, which contains data such as the postage amount and date in human readable form, graphic portion G which contains graphics such as a service provider logo or mailer advertisement and, encrypted portion 2DBC which contains encrypted data used to securely evidence payment of postage in a known manner as described above. Typically the encrypted data will be in a two dimensional bar code format such as the well known PDF 417 format.

Envelope 22 has width W and height H and right and upper edges 22R and 22U. Envelope 22 also has a fixed reserved clear area F. In accordance with Postal Service regulations reserved clear area F is a distance d1 from edge 22R, has width d2 and height d5, and lies along edge 22U.

Typically, in the prior art, portion HR is positioned in indicium I contiguous to the upper edge of portion 2DBC with the right edges aligned and portion G is contiguous to the upper edge of portion 2DBC with its right edge contiguous to the left edge of reserved clear area F. Portions HR and G have a height d4.

From the width W and height H of envelope 22 and characteristics of printer 14, driver 19 determines an unprintable area 26 in which system 10, as configured, cannot print and a complementary printable area 25. In the prior art, indicium I is positioned for printing in the upper right corner of envelope 22 at predetermined minimum distances from edges 22R and 22U in accordance with Postal Service regulations. As unprintable area 26 becomes greater than these minimum dimensions the position of indicium I is shifted down and to the left, remaining in the upper right corner of printable area 25. Since width d3 of portion HR is preferably chosen less then distance d1, and height d4 is preferably chosen greater than or equal to height d5, for a range of sizes for unprintable area 26 indium I will not overlap reserved clear area F. (Note that for other system configurations, unprintable area 26 can also extend along the left and/or lower edges of envelope 22 but since this does not substantially affect the embodiments described here this does not need to be discussed here.)

Figure 3:
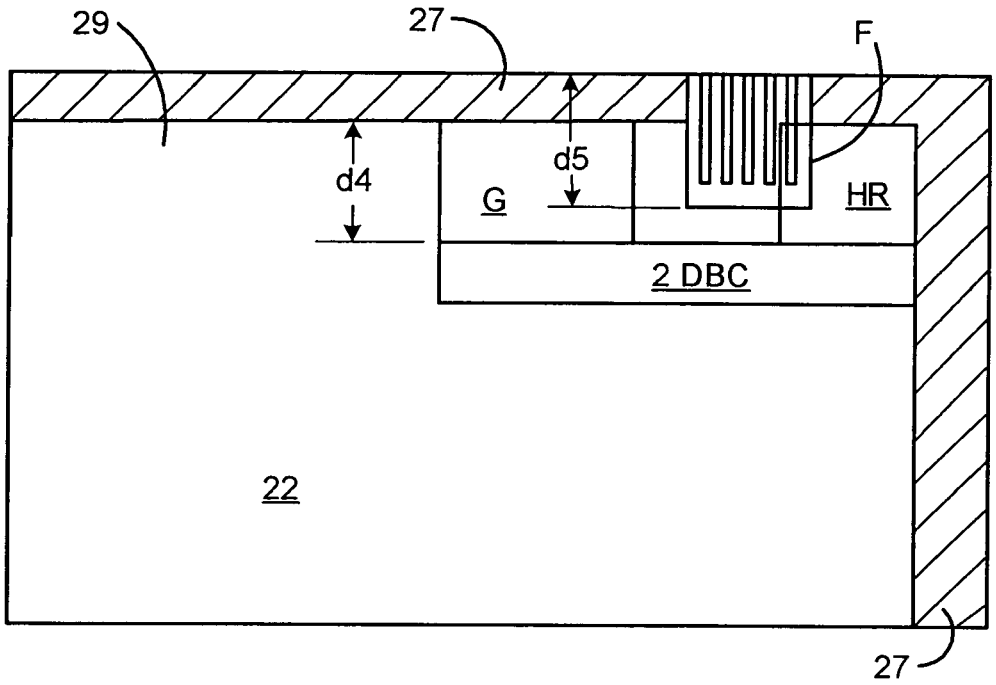
FIG. 3 shows a schematic representation of a mailpiece having an improperly printed IBIP type indicium.

FIG. 3 shows the possible effects of a change in system configuration; typically either a change in characteristics of printer 14 or in the dimensions of envelope 22. New unprintable area 27 and printable area 29 are determined and positioning indicium I in the upper right corner of printable area 29 causes portion HR to overlap the FIM mark in reserved clear area F.

Figure 4:
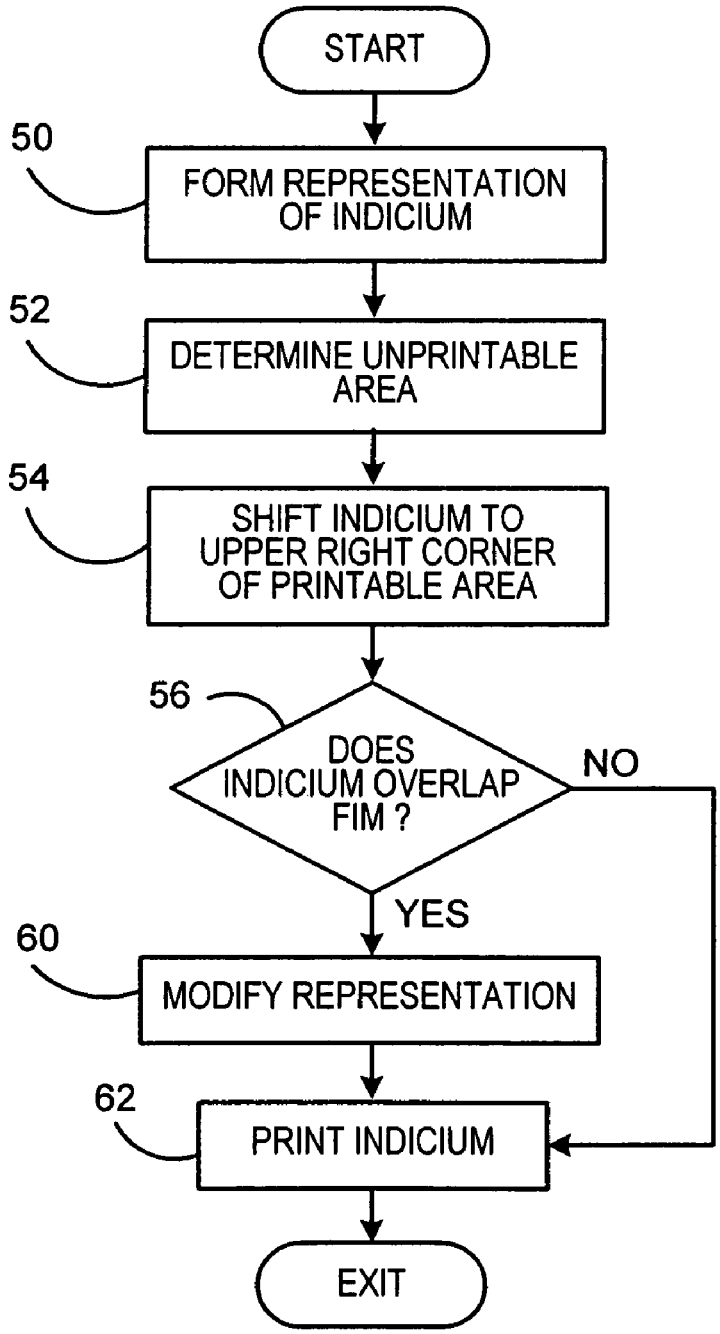
FIG. 4 shows a flow diagram of the operation of the system of FIG. 2 to modify the indicium of FIG. 1 to avoid improper printing.

Thus, in accordance with the subject invention, meter software 21 is modified as shown in the flow diagram of FIG. 4. At 50 data processing system 12 forms a digital representation of indicium I. (Typically the representation will include other elements such as a delivery address, but such other elements need not be discussed further here for an understanding of the invention.) At 52 system 12 determines the unprintable area and complementary printable area. At 54 system 12 shifts indicium I to the upper right corner of the printable area. (Or, if the unprintable area is small enough, to the predetermined minimum distances from edges 22R and 22U.) At 56 system 12 determines if indicium I overlaps reserved clear area F, thus overlying the FIM mark or the clear space provided around it. As shown above this will typically be because indicium I has been shifted left so that portion HR overlies area F. If so, at 60 system 12 shifts portions of indicium I with respect to each other so that none overlaps area F, as will be described further below; and at 62 prints the representation in a conventional manner and then exits. Otherwise, at 56 system 12 goes directly to 62 to print indicium I without modification.

Figure 5:
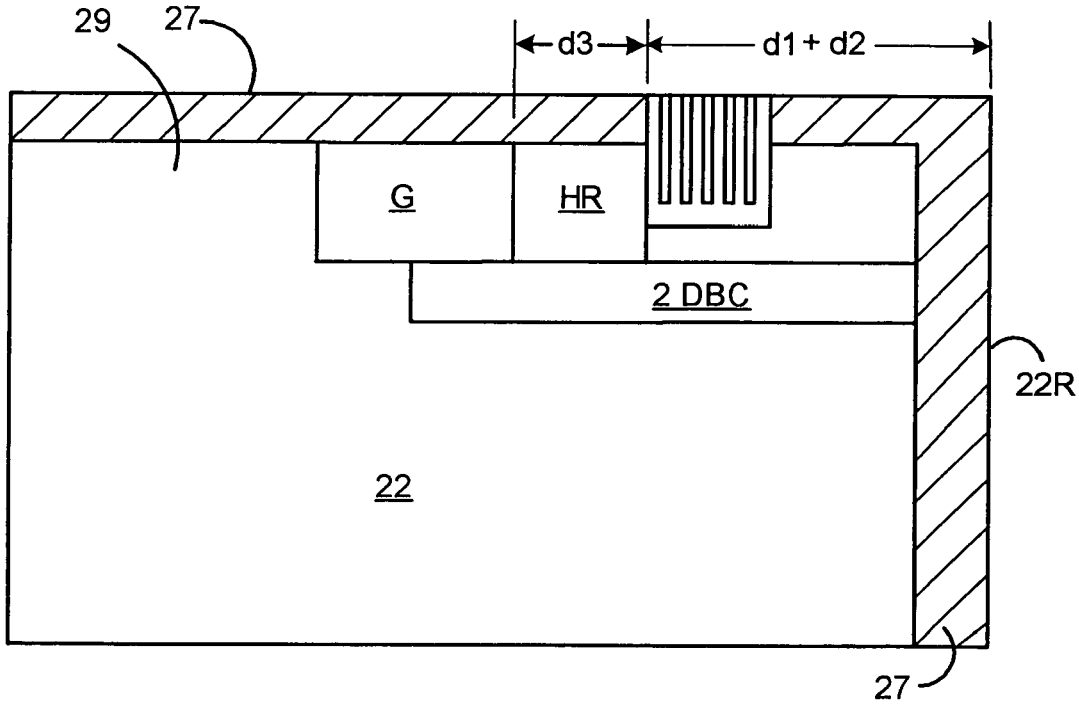
FIG. 5 shows modification of the indicium of FIG. 1 in accordance with one embodiment of the subject invention.

FIG. 5 shows modification of indicium I in accordance with a preferred embodiment of the subject invention. Portion G is shifted left a distance at least equal to d3 and portion HR is shifted left at least a distance d1+d2 from edge 22R so that portion HR is positioned between portion G and area F. Portion 2DBC is not shifted.

Figure 6:
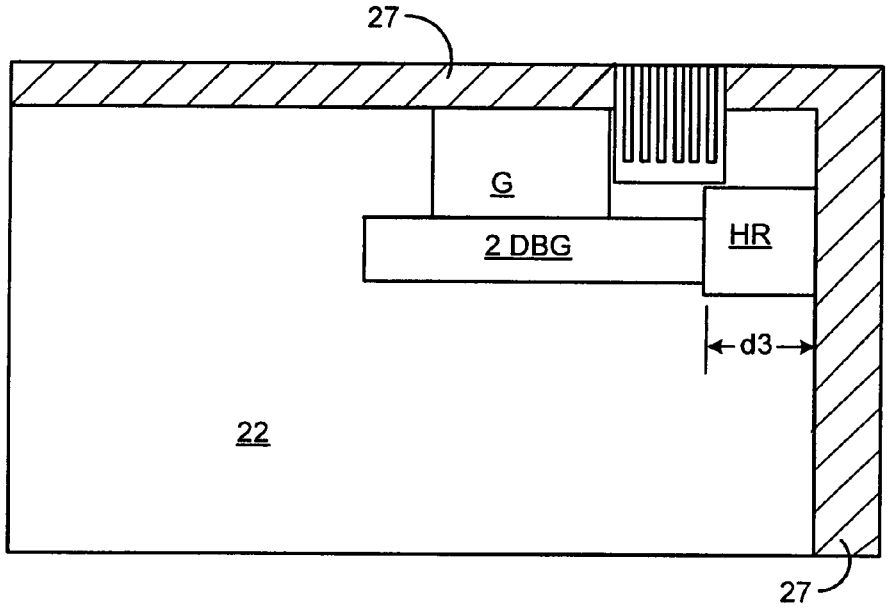
FIG. 6 shows modification of the indicium of FIG. 1 in accordance with another embodiment of the subject invention.

FIG. 6 shows modification of indicium I in accordance with another preferred embodiment of the subject invention. Portion HR is shifted down a distance at least equal to d5 from edge 22U and portion 2DBC is shifted left at least a distance d3 so that portion HR is positioned between portion 2DBC and unprintable area 27, and below area F. Portion G is not shifted.

The embodiments described above and illustrated in the attached drawings have been given by way of example and illustration only. From the teachings of the present application those skilled in the art will readily recognize numerous other embodiments in accordance with the subject invention. Particularly other modifications of various indicia printed with different geometries will be apparent. Accordingly, limitations on the subject invention are to be found only in the claims set forth below.

What is claimed is:

1. A method for controlling a digital printer to print an indicium on a surface of a substrate, said surface comprising a fixed reserved clear area, a variable unprintable area and a printable area, said method comprising the steps of:

a) determining a digital representation of said indicium, said representation comprising a plurality of portions;

b) determining said variable unprintable area as a function of said dimensions of said substrate and characteristics of said printer;

c) determining a position in said printable area for said indicium to be printed;

d) determining if printing said indicium in said position will cause one or more of said portions to overlap said fixed reserved clear area, and if not, downloading said representation to said printer for printing in said first position; and if so e) modifying said representation to shift portions in a predetermined manner in relation to each other so that none of said portions overlaps said fixed reserved clear area, and downloading said modified representation to said printer for printing in said position; whereby f) said indicium can be printed by different types of printers on substrates having different dimensions without overlap of fixed reserved clear areas despite variation in unprintable areas.

2. A method as described in claim 1 wherein said indicium is a postal indicium evidencing payment of postage and said substrate comprises a mailpiece.

3. A method as described in claim 2 wherein said indicium comprises encrypted data which cannot be generated without knowledge of a secret encryption key to provide security against unauthorized generation of indicia.

4. A method as described in claim 3 wherein said portions comprise a first portion and a second portion.

5. A method as described in claim 4 wherein said first portion is normally positioned to the right of said reserved clear area and said second portion is normally positioned below said reserved clear area, and if said first portion overlaps said reserved clear area, said indicium is modified by shifting said first portion to said left of said reserved clear area.

6. A method as described in claim 4 wherein said first portion is normally positioned to said right of said reserved clear area and said second portion is normally positioned below said reserved clear area and said first portion, and if said first portion overlaps said reserved clear area, said indicium is modified by shifting said second portion to the left and shifting said first portion below said reserved clear area into an area vacated by said second portion.

7. A system for printing an indicium on a surface of a substrate, said surface comprising a fixed reserved clear area, comprising:

a) a digital printer; and b) a data processing system controlling said printer, said data processing system being programmed to determine said variable unprintable area and said printable area as a function of the dimensions of said substrate and characteristics of said printer;

and said data processing system being further programmed to:

b1) determine a digital representation of said indicium, said representation comprising a plurality of portions;

b2) determine a position for said indicium to be printed in said printable area;

b3) determine if printing said indicium in said position will cause one or more of said portions to overlap said fixed reserved clear area, and if not, downloading said representation to said printer for printing in said position; and if so b4) modify said representation by shifting portions in a predetermined manner in relation to each other so that none of said portions overlaps said fixed reserved clear area, and downloading said modified representation to said printer for printing in said position; whereby c) said system can comprise different types of printers and said indicium can be printed by said different types of printers on substrates having different dimensions without overlap of fixed reserved clear areas despite variation in unprintable areas.

8. A system as described in claim 7 wherein said indicium is a postal indicium evidencing payment of postage and said substrate comprises a mailpiece.

9. A system as described in claim 8 wherein said indicium comprises encrypted data which cannot be generated without knowledge of a secret encryption key to provide security against unauthorized generation of indicia.

10. A system as described in claim 9 wherein said portions comprise a first portion and a second portion.

11. A system as described in claim 10 wherein said first portion is normally positioned to the right of said reserved clear area and said second portion is normally positioned below said reserved clear area, and if said first portion overlaps said reserved clear area, said indicium is modified by shifting said first portion to the left of said reserved clear area.

12. A system as described in claim 10 wherein said first portion is normally positioned to the right of said reserved clear area and said second portion is normally positioned below said reserved clear area and said first portion, and if said first portion overlaps said reserved clear area, said indicium is modified by shifting said second portion to said left and shifting said first portion below said reserved clear area into an area vacated by said second portion.

* * * * *